United States Patent [19]

Haulotte

[11] Patent Number: 4,498,596

[45] Date of Patent: Feb. 12, 1985

[54] SUPPLEMENTARY EQUIPMENT FOR USE WITH A SELF-PROPELLED CRANE WITH A TELESCOPIC JIB

[75] Inventor: Georges Haulotte, La Ravoire, France

[73] Assignee: Société des Ateliers de Construction, La Ravoire, France

[21] Appl. No.: 498,992

[22] Filed: May 27, 1983

[30] Foreign Application Priority Data

Jun. 11, 1982 [FR] France ..... 82 10185

[51] Int. Cl.[3] ..... B66C 23/78; B66C 23/04; B66C 23/26

[52] U.S. Cl. ..... 212/189; 212/223; 212/226; 212/231; 212/182; 212/244; 212/265

[58] Field of Search ..... 212/189, 223, 226, 230–231, 212/264–265, 267, 182

[56] References Cited

U.S. PATENT DOCUMENTS

| | | | |
|---|---|---|---|
| 1,743,123 | 1/1930 | Elwood | 212/189 |
| 2,452,632 | 11/1948 | Cameron | 180/8.1 |
| 3,308,967 | 3/1967 | Baokley et al. | 212/264 |
| 4,027,441 | 6/1977 | Pitelyaev et al. | 212/264 |
| 4,166,542 | 9/1979 | Boyan | 212/231 |
| 4,316,548 | 2/1982 | Helm et al. | 212/196 |
| 4,394,911 | 7/1983 | Wittman et al. | 212/189 |

FOREIGN PATENT DOCUMENTS

| | | | |
|---|---|---|---|
| 1140691 | 12/1962 | Fed. Rep. of Germany | 212/189 |
| 1,191,083 | 4/1965 | Fed. Rep. of Germany | 212/189 |
| 1481785 | 3/1969 | Fed. Rep. of Germany | 212/189 |
| 655950 | 8/1951 | United Kingdom | 212/183 |
| 680985 | 8/1979 | U.S.S.R. | 212/175 |

*Primary Examiner*—Trygve M. Blix
*Assistant Examiner*—R. B. Johnson
*Attorney, Agent, or Firm*—Pollock, Vande Sande & Priddy

[57] ABSTRACT

Supplementary equipment for use with a self-propelled crane with a telescopic jib to increase the possibilities of use of the crane on the ground comprising a support having a structure connected to the head of the jib and pivotally mounted on a platform of the crane, and an auxiliary jib articulated on the head of the jib. A strut is articulated at one end to the foot of the auxiliary jib and connected at its outer end to reeving articulated on the crane and controlled by a first winch and by a cable to the head of the auxiliary jib. A lifting hook is suspended by reeving from pulleys at the head of the jib and controlled by a cable connected to a second winch on the crane. The inclination and height of the auxiliary jib are controlled by the reeving and the first winch connected thereto, and angular movement of the jib about the vertical axis or pivotal movement of the structure on the platform is controlled by movement of the crane about that vertical axis.

4 Claims, 6 Drawing Figures

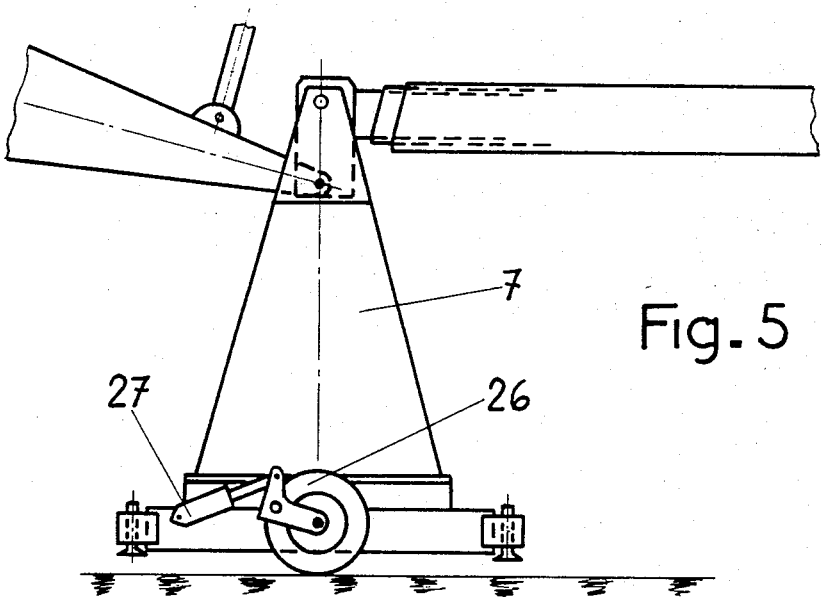
Fig. 5
Fig. 6
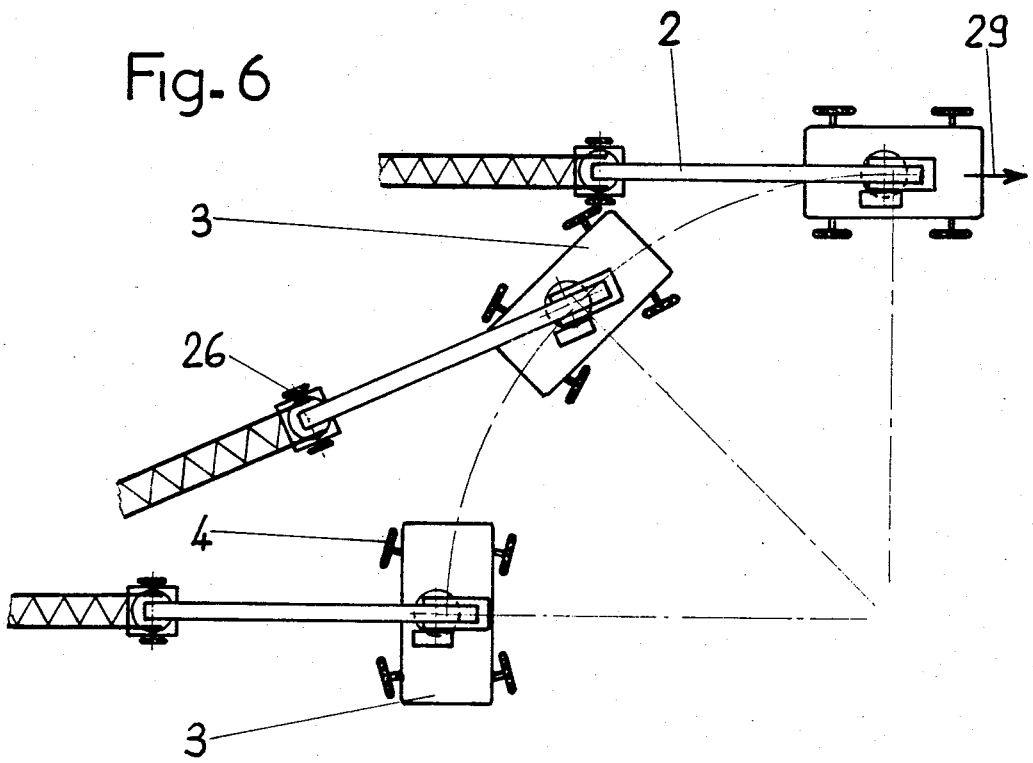

SUPPLEMENTARY EQUIPMENT FOR USE WITH A SELF-PROPELLED CRANE WITH A TELESCOPIC JIB

FIELD OF THE INVENTION

The present invention relates to supplementary equipment for use with a self-propelled crane with a telescopic jib for increasing the possibilities of use of the crane.

BACKGROUND OF THE INVENTION

Some work involves the need to hoist heavy loads to a very great height and in locations which are very difficult to reach. This is the case, for example, in the erection of metal pylons for lines of high or very high voltage. These pylons are installed in regions to which only cross-country cranes can gain access. However cranes of this type which are at present on the market have characteristics which do not allow them to carry out this kind of work. In particular, their maximum jib length is insufficient and their moment of stability is too low.

SUMMARY OF THE INVENTION

According to the present invention there is provided supplementary equipment for use with a self-propelled crane with a telescopic jib, comprising:

(a) support means having means for providing fixed support therefor on the ground, a platform, a structure supported on said platform and provided with connecting means for connection to the head of the jib of the crane, and means for permitting said connecting means to pivot about a vertical axis;

(b) an auxiliary jib, means for articulating the foot of said auxiliary jib relative to the head of the jib of the crane, and pulley means provided at the head of said auxiliary job for a hoisting cable;

(c) strut means, means for articulating one end thereof to the foot of said auxiliary jib, auxiliary reeving for connection between the other end of said strut means and the crane and for connection to a first winch, and cable means for connecting said other end of said strut means to said head of said auxiliary jib; and (d) lifting means and a hoisting cable therefor for passing over said pulley means on said head of said auxiliary jib and for connection to a second winch.

By use of the above described equipment it is possible to substantially increase the lifting capacity in terms of load and height of the crane.

Advantageously, the platform is provided with extendable and retractable arms making it possible to increase its stability on the ground. The platform can also be provided with retractable wheels which, with the supplementary equipment assembled, make it possible, for example, to move the assembly as a whole over the ground.

BRIEF DESCRIPTION OF THE DRAWINGS

An embodiment according to the present invention will now be described, by way of example only, with reference to the accompanying drawings.

In the drawings:

FIG. 5 is a side view of the support means of the equipment of FIG. 1 in a condition permitting it to move over the ground; and FIG. 6 shows diagrammatically a method of moving the assembly of FIG. 1 over the ground.

Figure 1:
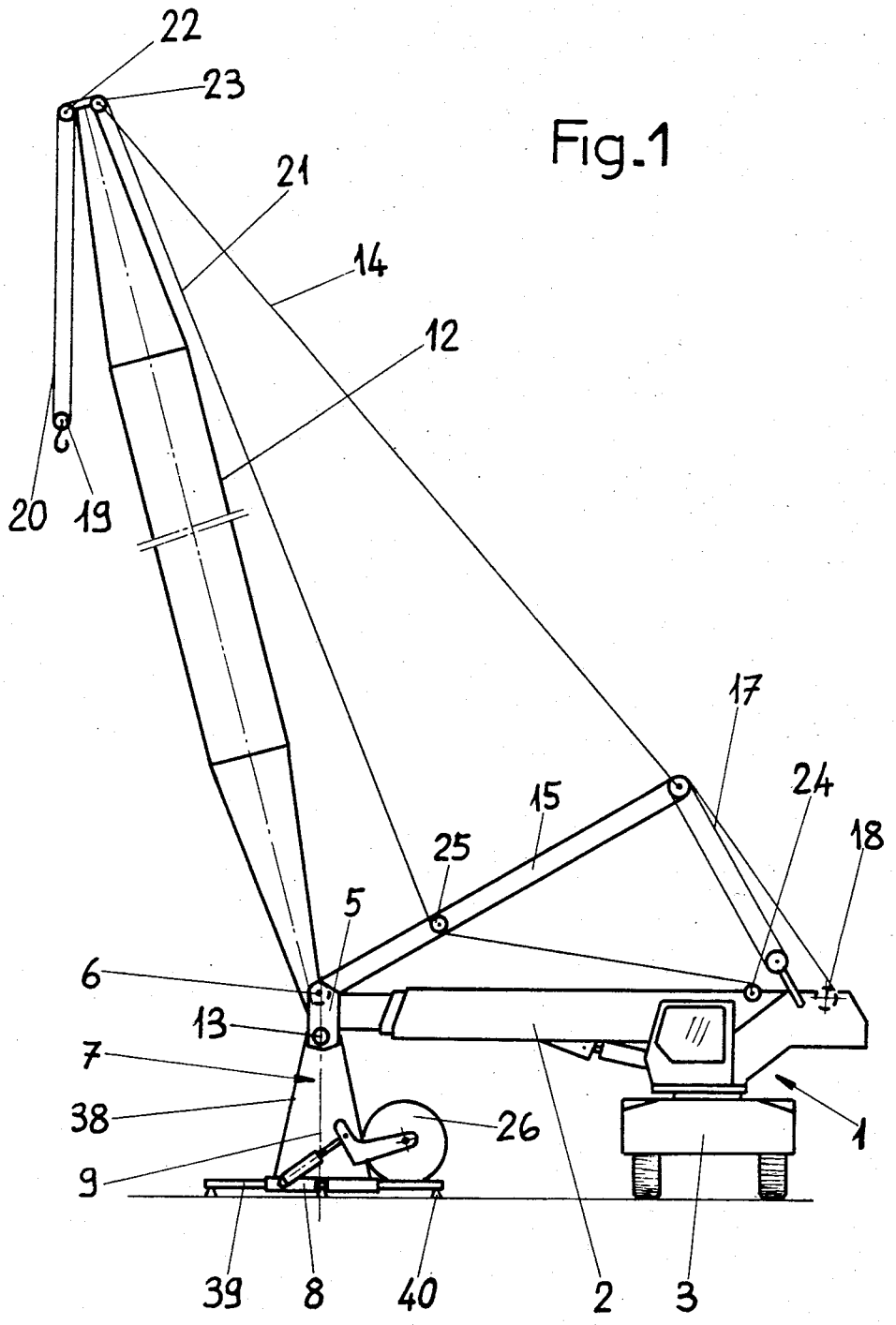
FIG. 1 is a general and diagrammatic side view of a crane and an embodiment of supplementary equipment in accordance with the present invention in working position on the ground.
Figure 2:
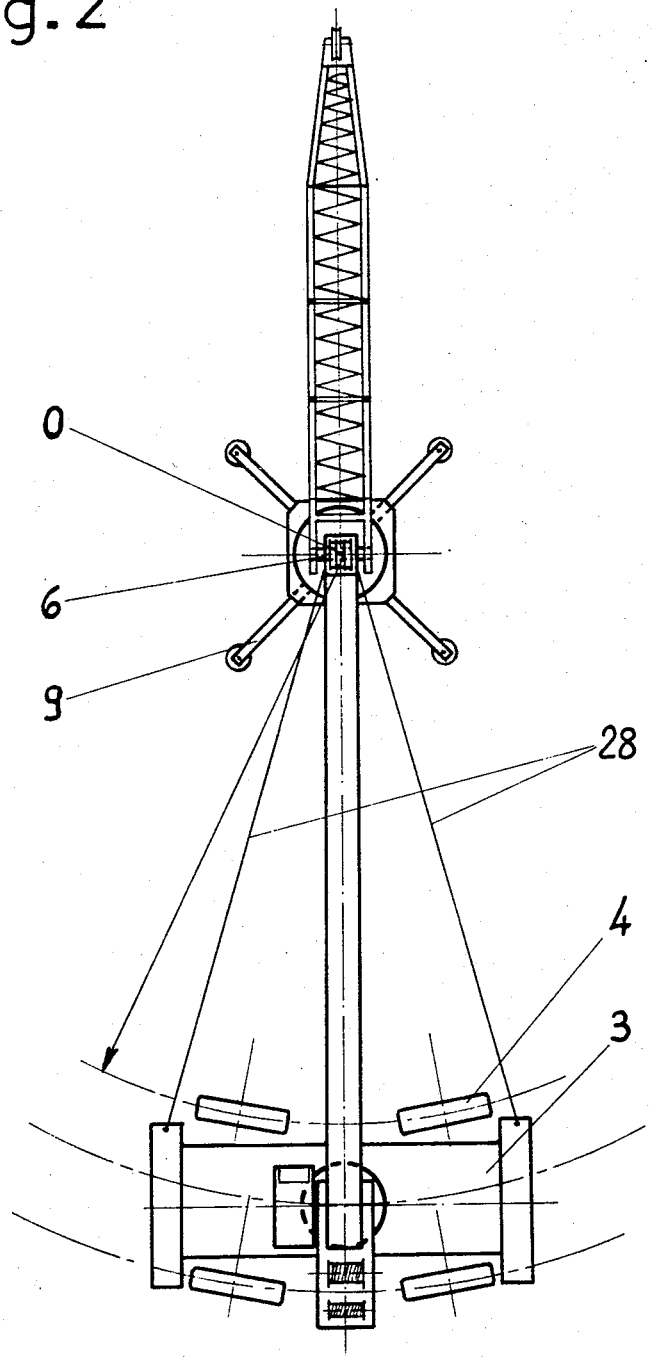
FIG. 2 is a plan view of the assembly of FIG. 1.
Figure 3:
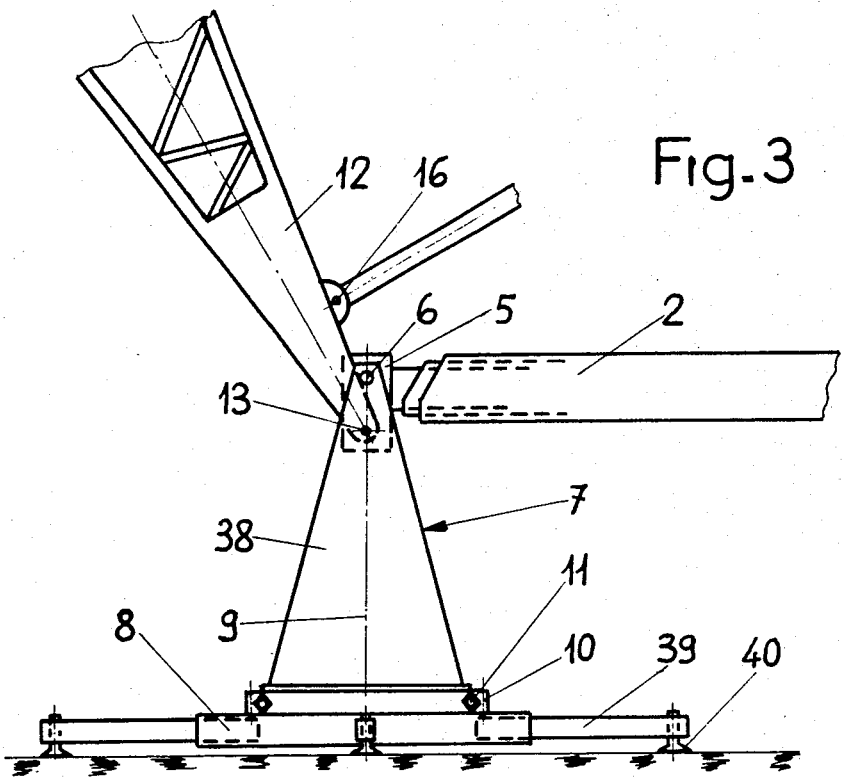
FIG. 3 is a side view of part of the equipment of FIG. 1 in working position.
Figure 4:
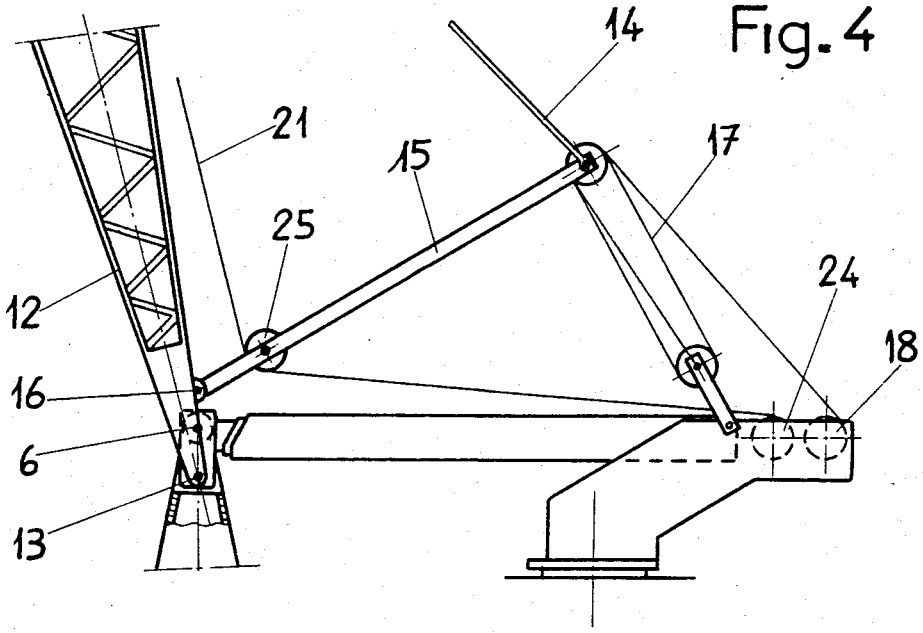
FIG. 4 is a more detailed side view of part of the equipment of FIG. 1.

Referring first of all to FIGS. 1 to 4, the assembly comprises a self-propelled cross-country crane with a telescopic jib, such as, for example, a crane 1 marketed by the applicant company under the trade name "PINGUELY TT 286", which is placed on the worksite with its jib 2 in a substantially horizontal and retracted position so that, as may be seen in FIG. 2, it is located at the center 0 of movement of the chassis 3 of the crane, the four wheels 4 being pivoted to the desired relative inclinations.

The head 5 of the jib 2 is connected by a shaft 6, which may be the shaft of the reeving pulleys, to a support means 7 bearing on the ground.

The support means 7 comprises a base platform 8 resting and supported on the ground by arms 39 which are extendable and retractable for increasing the stability of the support means and the ends of which incorporate supports 40 adjustable vertically so as to compensate for unevenness of the ground, and a framework 38 supported on the platform, the top of which is connected to the head 5 of the jib by the shaft 6.

The framework 38 is rotatable about a vertical axis of symmetry 9 by means of a pivotable ring 10 located between the framework and the base platform 8 and provided with ball bearings 11. The ring 10 has sufficient dimensions and characteristics to receive considerable vertical loads.

As may be seen in the drawings, an additional jib 12, or mast, as shown of the latticework type, which is made of fractional and, if appropriate, telescopic elements joined together on site by means of bolts or pins, is articulated at its foot to the jib head 5 of the crane by means of a shaft 13 which may also form part of the original reeving of the jib head 5.

The jib 12 is retained at its head by cables 14 connecting it to one end of a counter jib or strut 15, the other end of which is articulated on the jib 12 at a point 16 at or adjacent the foot thereof and which is retained at its other end by reeving 17 articulated on the body of the crane 1 and controlled by a winch on the crane, which winch may be the hoisting winch 18 of the said crane or a separate winch. As may be seen from FIG. 1, the variation in length of the reeving 17 makes it possible to incline the jib 12.

For lifting loads, a hook 19 is suspended from the end of reeving 20, with a cable 21 passing over the head of the jib 12 round pulleys 22, 23 and a guide pulley 25 on strut 15 and winding on a second winch 24 which may be the auxiliary winch of the crane or a separate winch.

A load carried by the jib 12 is oriented by moving the chassis 3 of the crane 1 without changing the inclination of the wheels 4, so that the assembly comprising the jib 12 and the crane 1 then rotates in a horizontal circle, the center of which is on the axis 9.

The lifting hook 19 of the auxiliary jib 12 therefore presents all the possibilities of movement of a standard crane, i.e., variation in height of the hook, variation in reach as a result of inclination of the jib 12, and angular variation as a result of rotation of the assembly about the axis 9.

The arrangement of the assembly shown in the drawings shows that the general moment of stability is very considerable, since the center of gravity of the crane is at a substantial distance from the center of rotation 9 of the support means 7. On the other hand, the vertical reactions attributable to the dead weight of the jib 12 and the load carried thereby are absorbed directly by the support means 7. Consequently, the components of the crane 1 absorb only some of the forces, resulting in compression in the jib and a lifting effect on the chassis 3.

The supplementary equipment therefore comprises the support means 7, the auxiliary jib or mast 12 with its pulleys 22, 23 and its shafts 6, 13 and 16, the strut 15 and the reeving 17 as well as the hook 19 and the reeving 20, although the latter may be taken from the standard equipment of the crane 1, the cable or cables 14 and finally the cable 21 and, if appropriate, the guide pulley 25. Of course, in the event that the telescopic crane 1 is not of a type incorporating an auxiliary winch 24 in addition to the standard winch 18, it will be necessary to add at least one winch to the supplementary equipment.

To make the assembly as rigid as possible, stays 28 may also be provided, either in the form of cables or rigid members, which stays connect the jib head 5 to ends of the chassis 3 to form a non-deformable triangulation.

The supplementary equipment is brought to the site by lorry or by the crane itself and is then assembled there to provide the structure shown in FIG. 1, the assembly operation preferably being carried out by means of the crane itself.

As may be seen in FIGS. 1 and 5, the support means 7 is advantageously provided with two wheels 26 which are retractable by means of jacks 27. These wheels 26 can be used to move the assembly once it has been constructed. In fact, the dead weight of the supplementary equipment, once it has been assembled, can exceed the possible lifting capacities of the crane on tires with the jib horizontal.

To move the constructed assembly, the support means 7 is raised, by means of the jacks 27 which cause the wheels 26 to pivot in such a way as to place the support means on its wheels. The turret of the crane 1 is then allowed freedom of orientation, and, as may be seen in FIG. 6, the self-propelled chassis 3 of crane 1 is moved by rolling, the wheels 4 being turned in an opposite direction to that used previously (as shown in FIG. 2).

FIG. 6 shows the respective paths of the chassis 3 and the wheels 26. The latter are such that the jib 2 and the supplementary equipment are positioned quickly on the axis 29 of the chassis of the crane, movement taking place in the same way as that for a trailer coupled to a vehicle.

What is claimed is:

1. A crane assembly comprising a self-propelled crane having a self-propelled chassis, a telescopic jib mounted on said chassis, and supplementary equipment, said assembly comprising (a) support means comprising a platform, means providing fixed support for said platform on the ground, a structure supported on said platform, means connecting said structure to the head of said jib of said crane, and means permitting pivotal movement of said structure relative to said platform;

(b) an auxiliary jib having a head and a foot, means articulating said foot of said auxiliary jib relative to said head of said jib of said crane, pulley means for a hoisting cable, and means mounting said pulley means at said head of said auxiliary jib;

(c) strut means, means articulating one end thereof to the foot of said auxiliary jib, auxiliary reeving connecting the other end of said strut means to a first winch on said crane, and cable means connecting said other end of said strut means to said head of said auxiliary jib; and (d) lifting mans, and a hoisting cable therefor passing over said pulley means on said head of said auxiliary jib and connected to a second winch.

2. A crane assembly according to claim 1, including retractable wheels mounted on said platform.

3. A crane assembly according to claim 1, wherein said first winch comprises a hoisting winch.

4. A crane assembly according to claim 1 or 3, wherein said second winch comprises an auxiliary winch.

* * * * *